US006510703B1

(12) United States Patent
Weng

(10) Patent No.: US 6,510,703 B1
(45) Date of Patent: Jan. 28, 2003

(54) METHOD FOR CONTROLLING CORRESPONDING ENERGY SUPPLY OF A HEAT SOURCE UNIT OF A REFRIGERATION AIR CONDITIONING SYSTEM BASED ON REQUIRED ENERGY VALUE CALCULATED FROM OUTPUT POWER VALUE

(75) Inventor: Kuo-Liang Weng, Taichung Hsien (TW)

(73) Assignee: Cohand Technology Co., Ltd., Taichung Hsien (TW)

( * ) Notice: Subject to any disclaimer, the term of this patent is extended or adjusted under 35 U.S.C. 154(b) by 0 days.

(21) Appl. No.: 09/993,681

(22) Filed: Nov. 27, 2001

(51) Int. Cl.[7] ..... F25B 7/00; F25B 1/00
(52) U.S. Cl. ..... 62/230; 62/175
(58) Field of Search ..... 62/230, 175, 214, 62/215, 238.6

(56) References Cited

U.S. PATENT DOCUMENTS 5,207,071 A * 5/1993 Ozu et al. ..... 62/175
5,390,506 A * 2/1995 Sogabe et al. ..... 62/175

* cited by examiner

*Primary Examiner*—Denise L. Esquivel
*Assistant Examiner*—Marc Norman
(74) *Attorney, Agent, or Firm*—Rosenberg, Klein & Lee

(57) ABSTRACT

A method for controlling corresponding energy supply of a heat source unit of a refrigeration air conditioning system based on required energy value calculated from output power value mainly includes a controller coupled with a heat exchanger unit at the refrigeration air conditioning loading side that matches a heat source unit of a refrigeration air conditioning system. The controller includes a power value detection unit to detect the delivered loading power value, and through a center micro processing unit to process air conditioning required energy value which is transferred to a refrigeration air conditioning required energy value calculation unit to accumulate total required energy value. The total required energy value is dynamically fed to a heat source controller to control optimal heat source supply of the heat source unit such that the system is maintained the optimum operation condition to effectively save energy and achieve higher operation efficiency.

3 Claims, 10 Drawing Sheets

METHOD FOR CONTROLLING CORRESPONDING ENERGY SUPPLY OF A HEAT SOURCE UNIT OF A REFRIGERATION AIR CONDITIONING SYSTEM BASED ON REQUIRED ENERGY VALUE CALCULATED FROM OUTPUT POWER VALUE

BACKGROUND OF THE INVENTION

1. Field of the Invention

The invention relates to a method for controlling corresponding energy supply of a heat source unit of a refrigeration air conditioning system based on required energy value calculated from output power value for maintaining the system at an optimal energy consumption condition and reaching a higher operation efficiency.

2. Description of the Prior Art

In the past, operation of the heat source unit of a refrigeration air conditioning system is determined merely by the selection of air conditioning supply for the refrigeration air conditioning room (region) without considering the requirements of the refrigeration air conditioning room (region). As a result, excessive energy has been wasted. To remedy this shortcoming, an improved refrigeration air conditioning system has been developed and introduced as shown in FIG. 1. Such a system mainly includes a heat source unit 11 coupling with a heat exchanger unit 12 on the refrigeration air conditioning load side. The heat exchange unit 12 on the refrigeration air conditioning loading side has a heat exchanger 13, an air fan motor M1, a setting unit F11, a sensor T11 and a controller 120 (also shown in FIG. 2). The resulting system provides refrigeration air conditioning (i.e. heat source supply) to a refrigeration air conditioning region R10. The controller 120, based on the sensed and detected value TA of the sensor T11 and setting value TAS of the setting unit F11, and through calculation and comparison of a central micro processing unit 121, drives an output unit 123 and a power supply unit 122 to supply electricity to the air fan motor M1 to control its rotation speed. Though such a system can control the rotation speed of the air fan motor M1 and has improvement over the constant air flow of the conventional techniques, there are still disadvantages regarding energy consumption, notably the following.

1. While the system can control the rotation speed of the air fan motor based on requirement changes of the refrigeration air conditioning region, the heat source supply of the heat source unit has not been controlled to change synchronously. As a result, heat source unit always supplies energy at a constant rate without regarding the actual requirements of the refrigeration air conditioning region R10. Hence heat source supply is greater than the loading most of the time. The operation of the main machinery has to be turned on or off intermittently to supply desired amount of heat source to adjust heating load of the refrigeration air conditioning region R10.

2. Because of aforesaid phenomenon, a lot of energy is wasted. This is mainly caused by the heat source unit not being able to dynamically measure the energy requirements of the heat exchanger unit at the refrigeration air conditioning loading side and cannot supply corresponding heat source. In other words, the heat exchanger unit at the refrigeration air conditioning loading side does not dynamically provide its requirements to the heat source unit, and consequently results in huge energy loss.

SUMMARY OF THE INVENTION

In view of aforesaid disadvantages, the primary object of the invention is to provide a control method that calculates required energy value based on output power value of the refrigeration air conditioning loading side thereby allowing the heat source unit to generate corresponding heat source supply so that the heat source unit can dynamically proceed matching adjustment based on air conditioning required energy of the heat exchanger unit at the refrigeration air conditioning loading side to save energy.

The foregoing, as well as additional objects, features and advantages of the invention will be more readily apparent from the following detailed description, which proceeds with reference to the accompanying drawings.

DETAILED DESCRIPTION OF THE INVENTION

Figure 1:
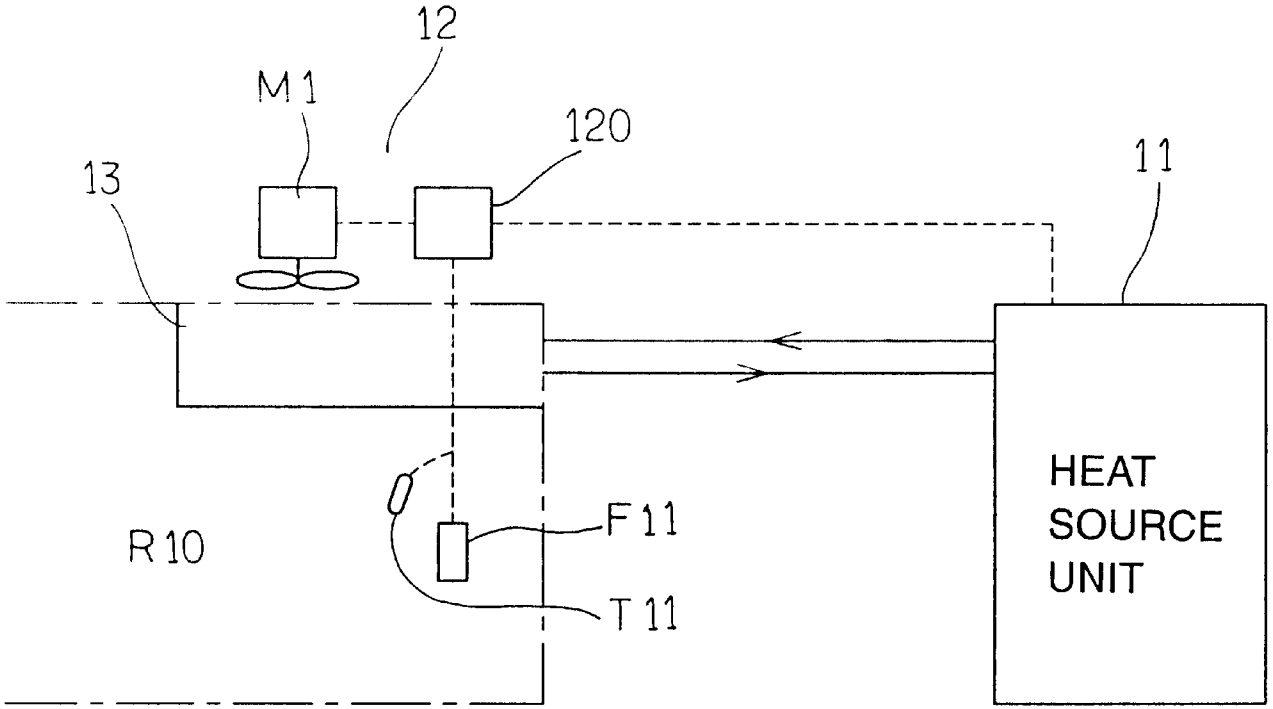
FIG. 1 PRIOR ART
FIG. 1 is a diagram of a conventional refrigeration air conditioning system.
Figure 2:
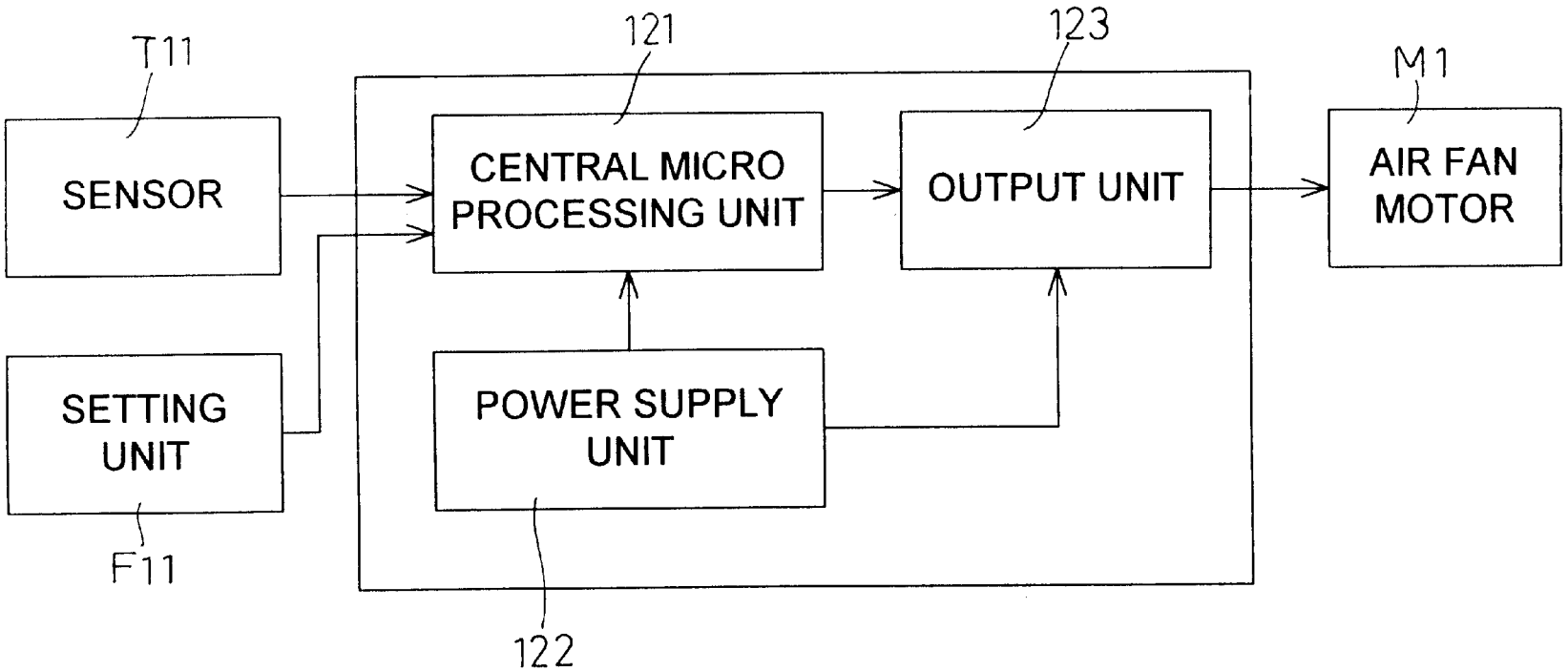
FIG. 2 PRIOR ART
FIG. 2 is a control block diagram of a conventional refrigeration air conditioning system.
Figure 3:
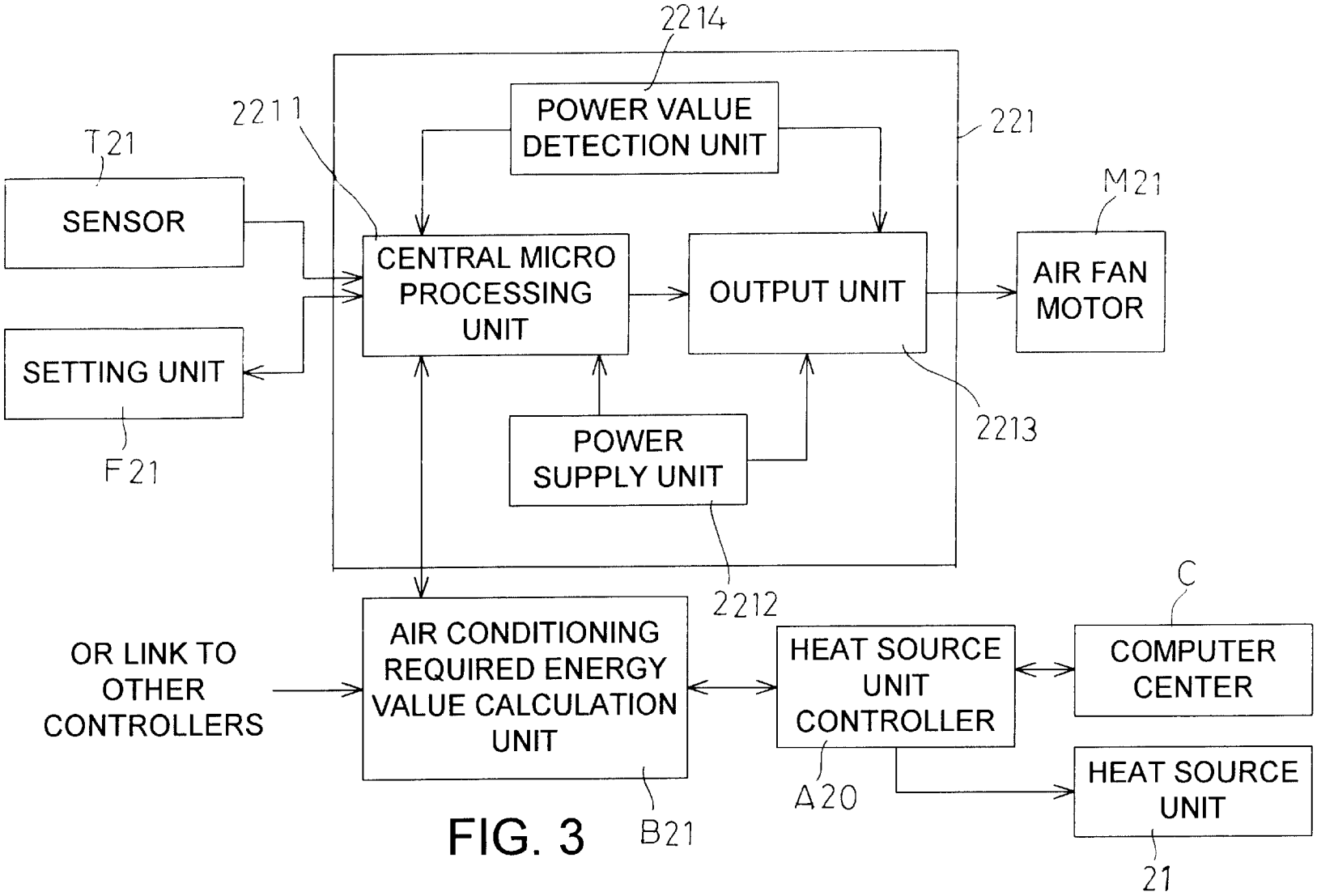
FIG. 3 is a schematic block diagram of a control apparatus of the invention.

Referring to FIG. 3 for a schematic block diagram of a control apparatus of the invention, the apparatus mainly includes a controller 221 which consists of the following elements:

- a central micro processing unit 2211 which is a central processing unit (CPU) for receiving various detecting values and setting parameter values, and performing comparisons and processes, and outputting corresponding values and control signals, etc;
- a sensor T21 including at least one sensor element for detecting the temperature value of targeting regions and transmitting the value to the central micro processing unit 2211;
- a setting unit F21 for setting parameter values to provide the central micro processing unit 2211 for comparing and processing against the detected values;
- an output unit 2213 based on the control signals from the central micro processing unit 2211 to control a power supply unit 2212 to supply electric power to an air fan motor M21 of a heat exchanger unit 22 at the refrigeration air conditioning loading side, such as an air fan motor M21 of an evaporator (or the air fan motors of other air conditioning casings, indoor air fans and the like);
- a power supply unit 2212 for supplying electric power required by the controller and the air fan motor M21 of the heat exchanger unit 22 at the refrigeration air conditioning loading side (such as the air fan motors of air conditioning casings, indoor air fans and the like); and
- a power value detection unit 2214 for detecting power values output from the output unit 2213.

By means of the construction set forth above, the central micro processing unit 2211 can process the output power value P detected by the power value detection unit 2214 and get the required refrigeration air conditioning energy values Q1*a*1 (Q1*a*2, . . . , Q1*a*n, Q2*a*2, . . . , Qna1, . . . , Qnan), then transfers to an air conditioning required energy value calculation unit B21 to calculate total required refrigeration air conditioning energy value ΣQ. The air conditioning required energy value calculation unit B21 has the capability of performing statistical function on the required refrigeration air conditioning energy values for various controllers 221, and transfers the total required refrigeration air conditioning energy value ΣQ to a heat source unit controller A20. The controller A20 based on the energy value ΣQ controls the heat source unit 21 to supply corresponding heat source to the amount of Qe. The heat source unit controller A20 may also be linked to a computer center C.

Figure 4:
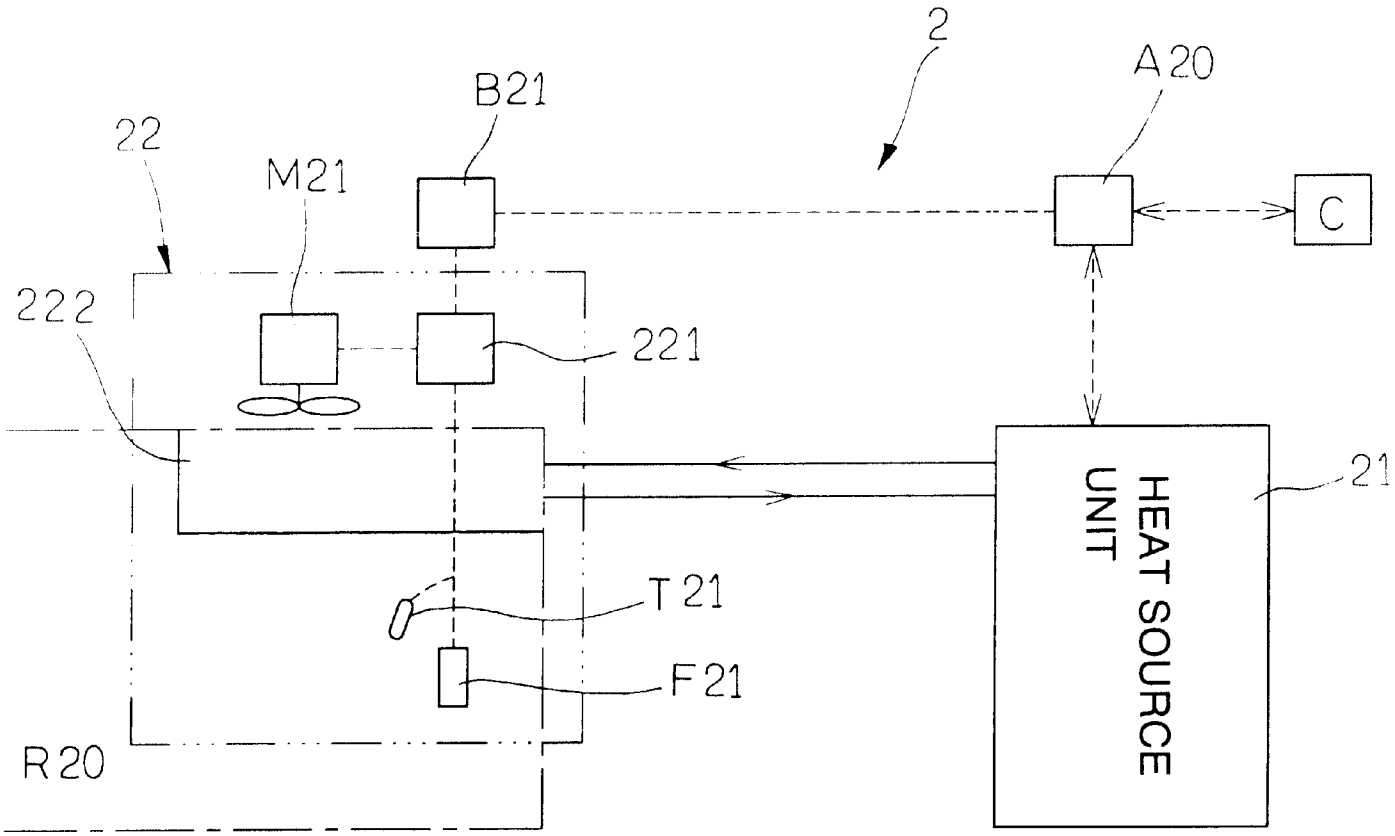
FIG. 4 is a diagram of a single unit configuration system embodiment of the invention.

Referring to FIG. 4 for a diagram of a single unit configuration system embodiment of the invention, the system 2 mainly includes a heat source unit 21 coupling with a heat exchanger unit 22 at the refrigeration air conditioning loading side, wherein:

the heat source unit 21 is linked to a heat source unit controller A20 and receives the signals thereof, and supplies heat source to the amount of Qe corresponding to the heat exchanger unit 22 at the refrigeration air conditioning loading side;

the heat exchanger unit 22 at the refrigeration air conditioning loading side includes a controller 221, a heat exchanger 222, an air fan motor M21, a sensor T21 and a setting unit F21. The controller 221 includes a central micro processing unit 2211, a power supply unit 2212, an output unit 2213 and a power value detection unit 2214. The power value detection unit 2214 detects loading side output power value P and through the central micro processing unit 2211 to calculate the required energy value Q1*a*1 of refrigeration air conditioning, then the value Q1*a*1 is passed to the air conditioning required energy value calculation unit B21 and is converted to total required refrigeration air conditioning energy value ΣQ. And the heat source unit controller A20 based on the comparison of the value ΣQ and the setting value QS controls the heat source unit 21 to supply corresponding heat source to the amount of Qe (also referring to FIG. 3).

The power value detection unit 2214 detects loading side output power value P and converts to total required refrigeration air conditioning energy values ΣQ and heat source supply amount Qe. According to fan laws, air flow volume F, rotation speed ω, and consuming power P of the air fan motor and refrigeration air conditioning power Q have the following relationship:

1. The air flow volume F is directly proportional to the rotation speed ω of the air fan motor (i.e. F and ω are directly proportional with each other).

2. The rotation speed ω of the air fan motor is directly proportional to the consuming power P of the air fan motor (i.e. ω and P of the output power at the loading side are directly proportional with each other).

3. The refrigeration air conditioning power (i.e. required energy Q for refrigeration air conditioning) is directly proportional to the air flow volume F (i.e. F and Q are directly proportional with each other).

4. The refrigeration air conditioning power Q is directly proportional to the motor consuming power value P (i.e. P and Q are directly proportional with each other).

The relationship between P and Q set forth above may be further induced to derive the refrigeration air conditioning power Q based on the motor consuming power value P (i.e. Q1*a*1, Q1*a*2, . . . , Qnan). They have a ΣQ=KP relationship (K is a program conversion coefficient, ΣQ=Q1*a*1+Q1*a*2+ . . . +Qnan, and ΣQ=Qe, therefore Qe=ΣQ=KP).

By means of the foregoing construction and based on the total required refrigeration air conditioning energy value ΣQ in the refrigeration air conditioning room R20 from the heat exchanger unit 22 at the refrigeration air conditioning loading side, the heat source unit controller A20 may control heat source supply amount Qe of the heat source unit 21 of the refrigeration air conditioning system. The sensor T21 measures the environmental temperature value Ta of the refrigeration air conditioning room R20 and the setting value Tas set by the setting unit F21. After the processing and comparison done by the central micro processing unit 2211 of the controller 221, a control signal is output to the output unit 2213 to control the electric power delivering to the air fan motor M21. The power value detection unit 2214 detects power value P1*a*1 output from the output unit 2213 and transfers to the central micro processing unit 2211 which converts to refrigeration air conditioning required energy value Q1*a*1. The required energy value Q1*a*1 is transferred to the air conditioning required energy value calculation unit B21 which accumulates total required refrigeration air conditioning energy value ΣQ, then the heat source unit controller A20, based on the comparison results of the value ΣQ and the setting value QS, controls heat supply amount Qe of the heat source unit 21.

Figure 5:
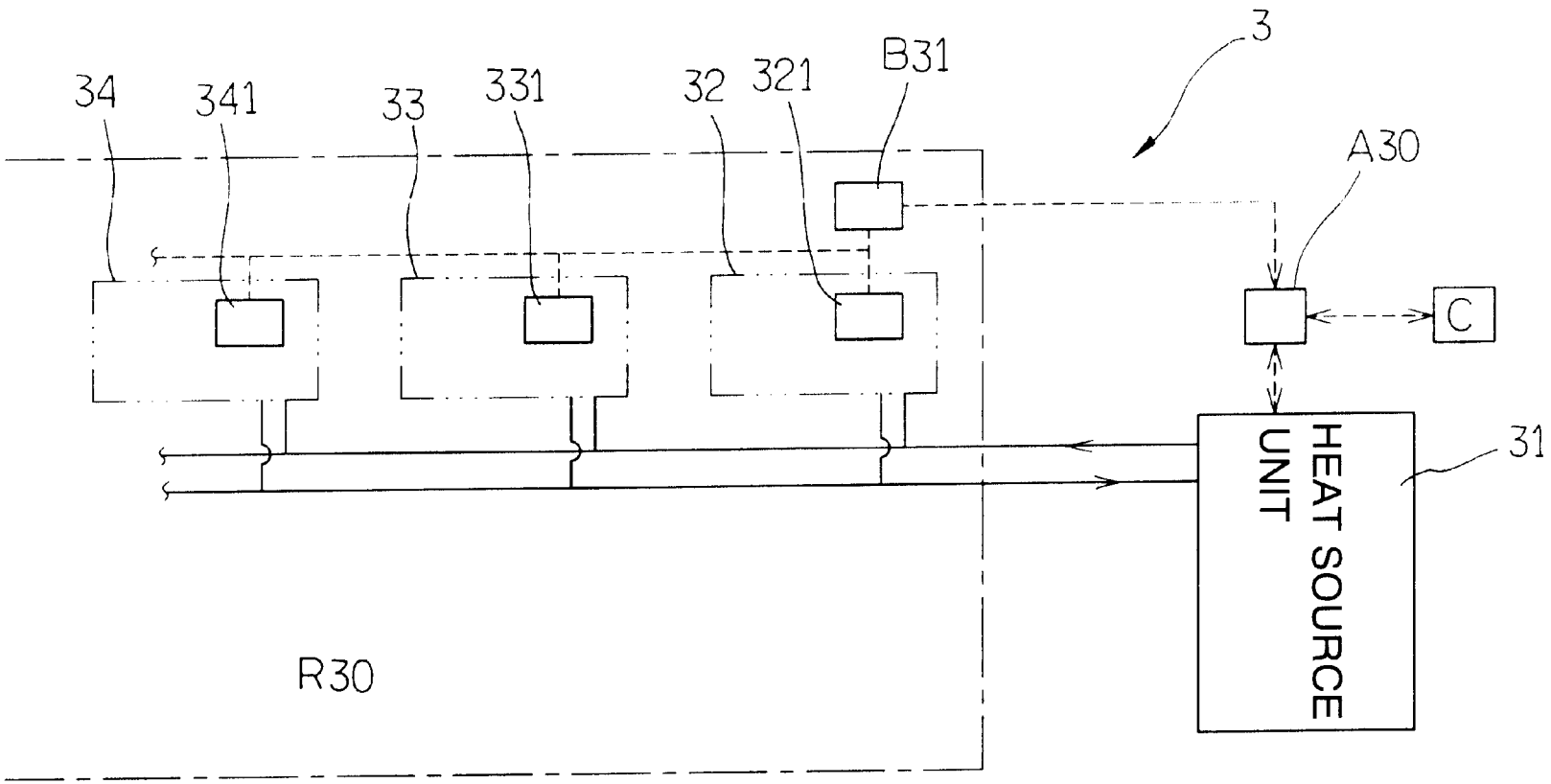
FIG. 5 is a diagram of a single region configuration system embodiment of the invention.

Referring to FIG. 5 for a diagram of a single region configuration system embodiment of the invention, the system 3 consists of a heat source unit 31 coupling with a plurality of heat exchanger units 32, 33, 34, . . . at the refrigeration air conditioning loading side to supply heat source to a refrigeration air conditioning region R30. The heat exchanger units 32, 33, 34, . . . have respectively a controller 321, 331, 341, . . . which are same as the one shown in FIG. 3. The measured power values P1*a*1, P1*a*2, . . . , P1*a*n are processed and converted to the refrigeration air conditioning required energy values Q1*a*1, Q1*a*2, . . . , Q1*a*n and are transferred to an air conditioning required energy value calculation unit B31 to derive the single region air conditioning required energy value QA1 (QA1 value is equal to ΣQ under such a condition). Then a heat source unit controller A30 based on the comparison result of the value QA1 and the setting value QS controls heat supply amount Qe of the heat source unit 31.

Figure 6:
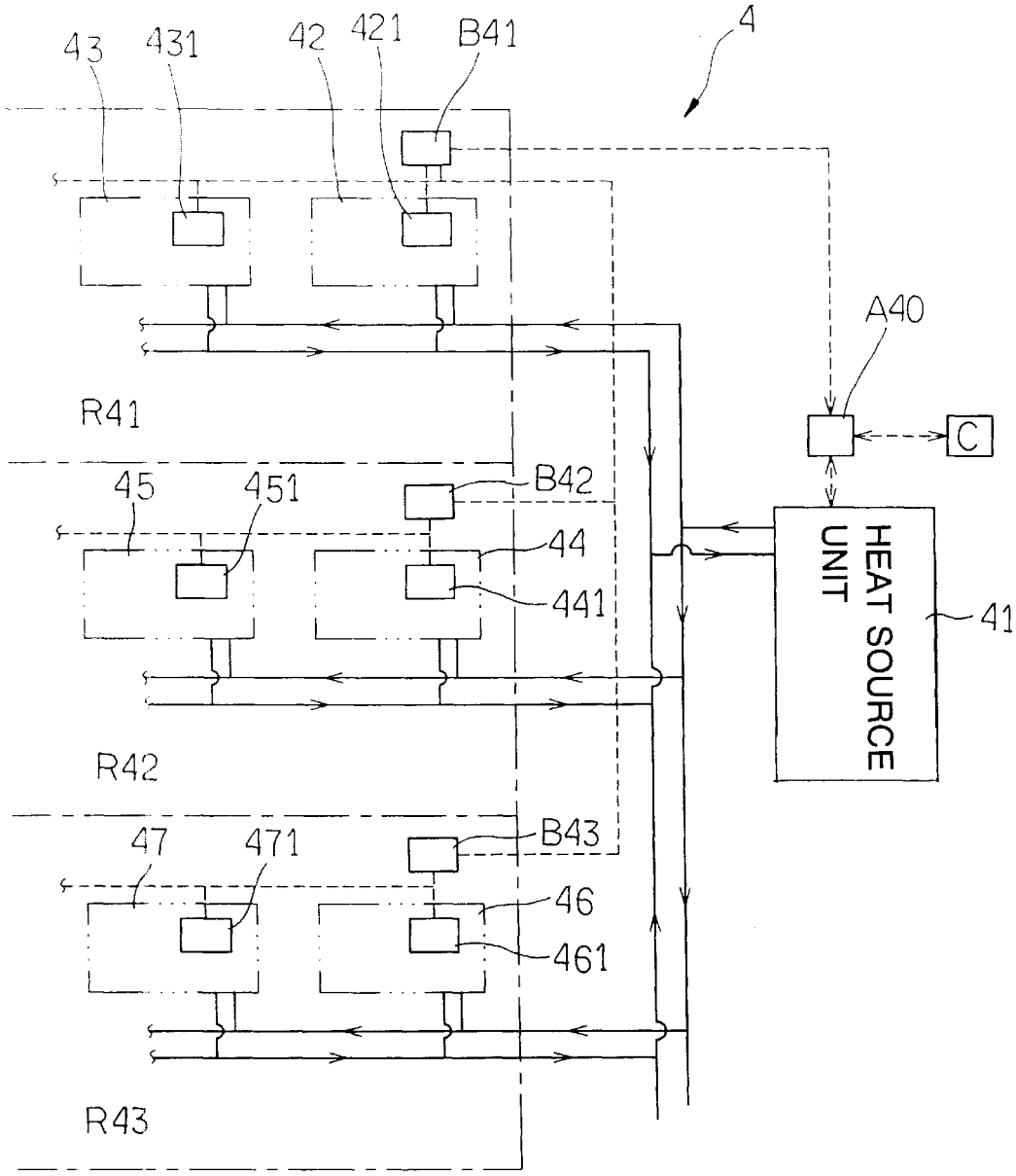
FIG. 6 is a diagram of a multi-region configuration system embodiment of the invention.
Figure 7:
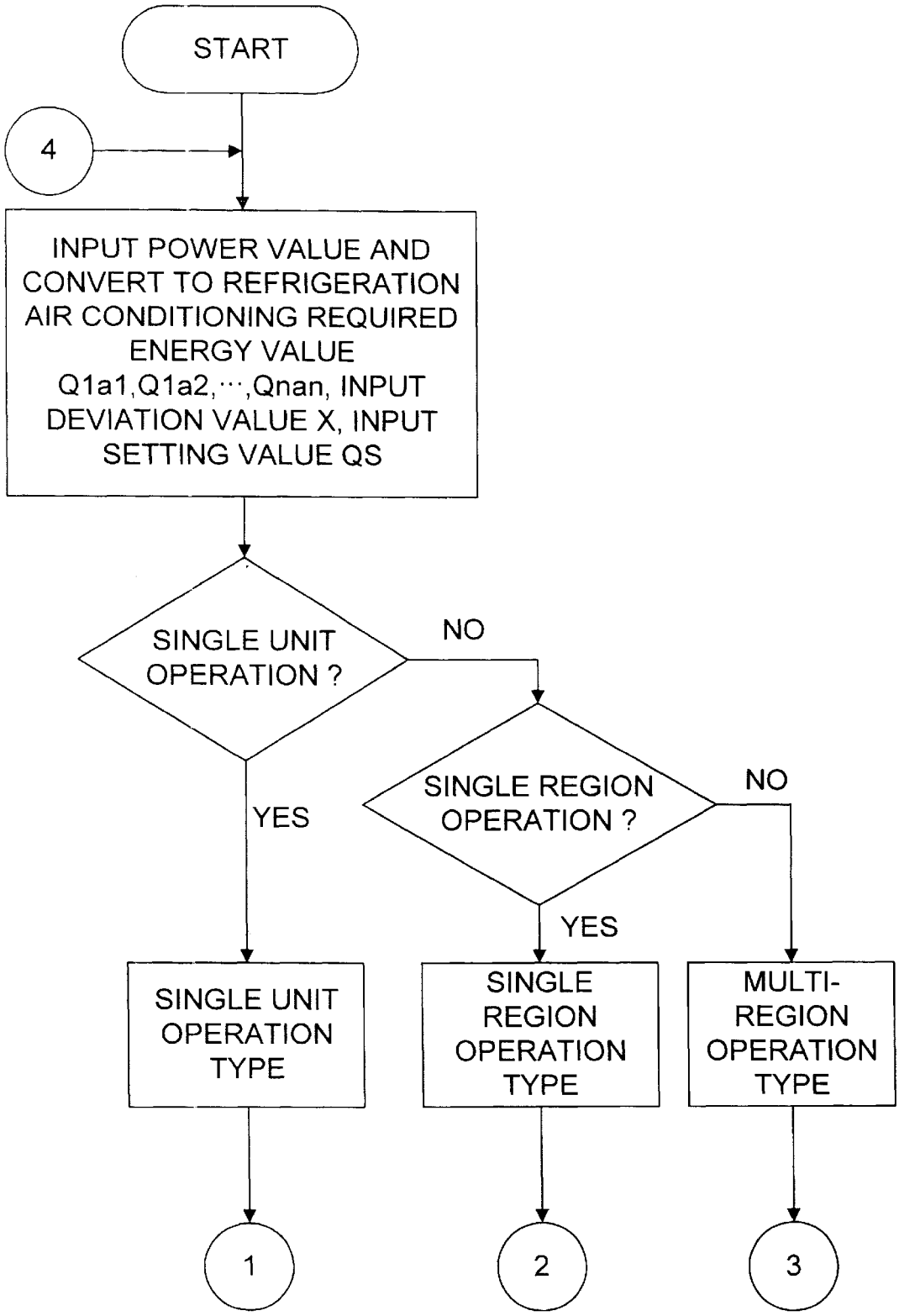
FIG. 7 is a control flow chart (1) of the invention.
Figure 8:
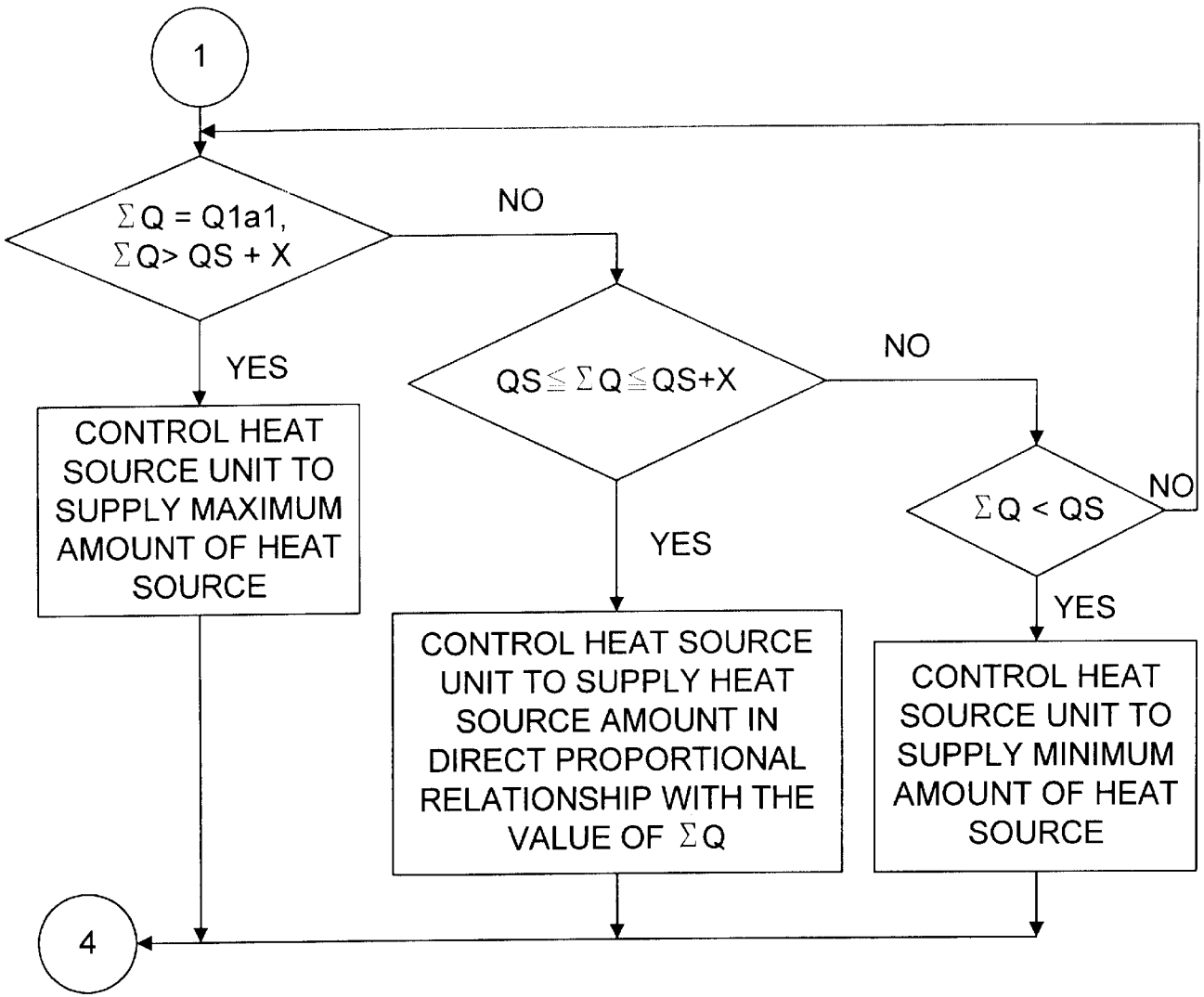
FIG. 8 is a control flow chart (2) of the invention.
Figure 9:
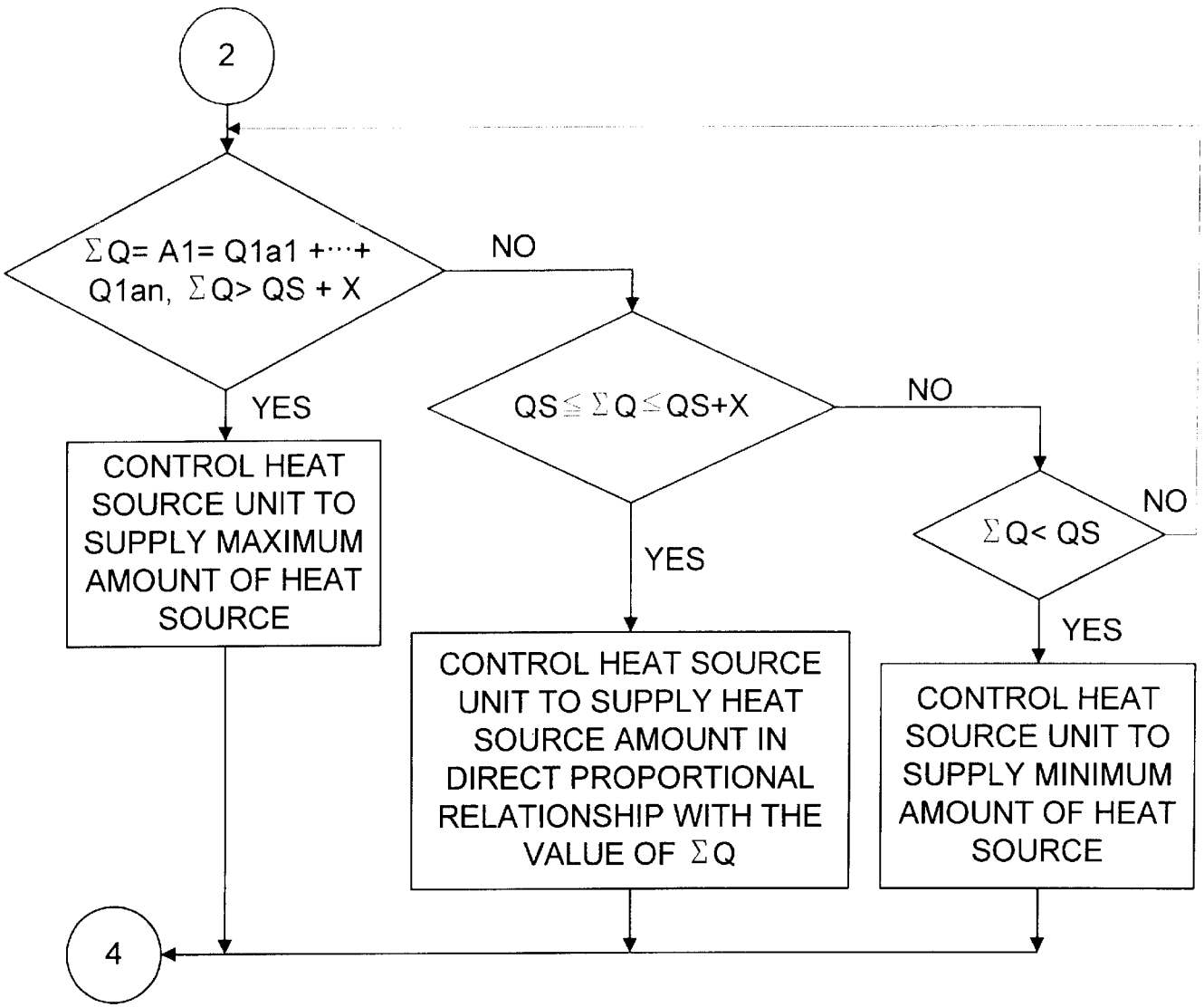
FIG. 9 is a control flow chart (3) of the invention.
Figure 10:
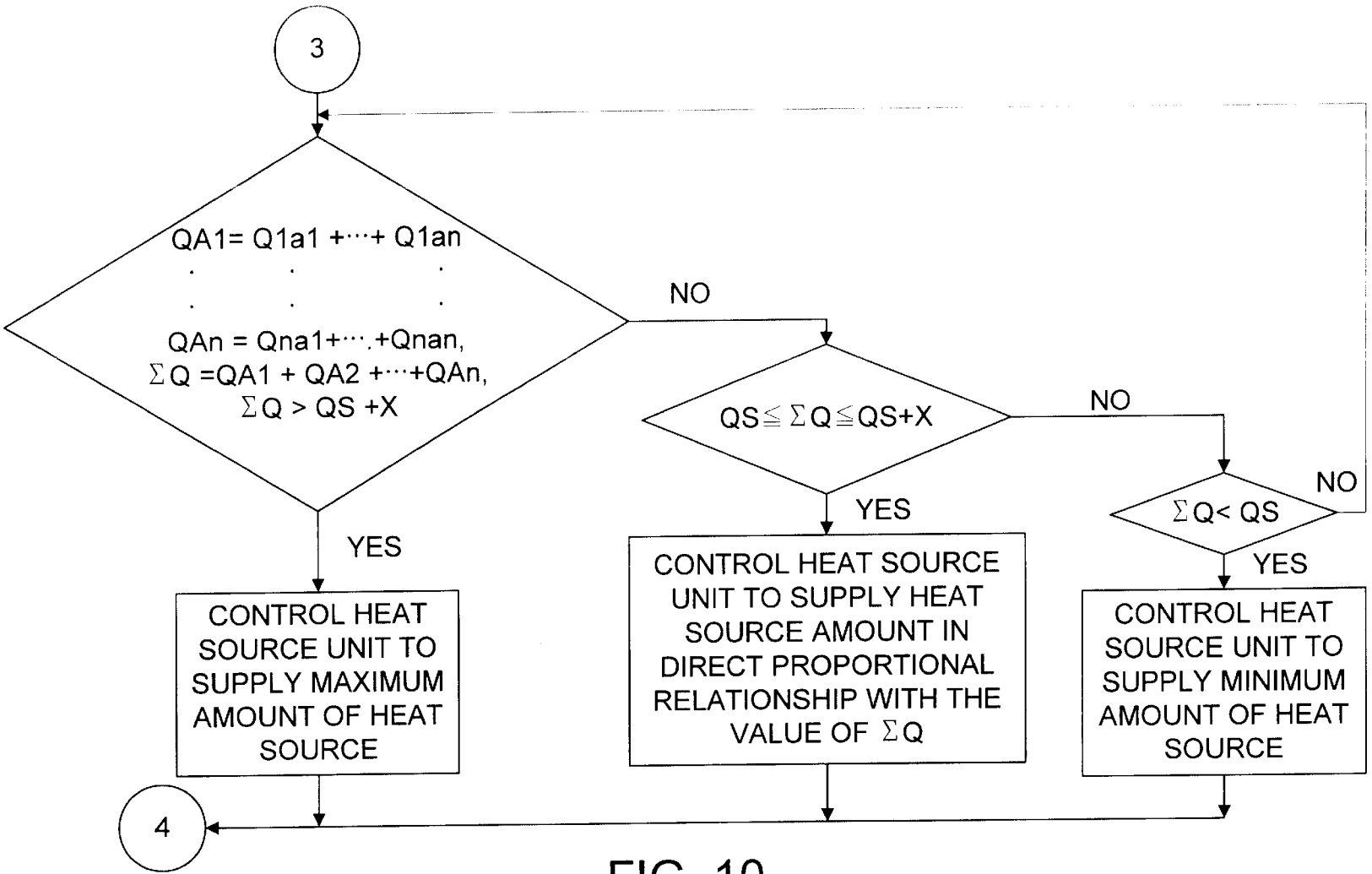
FIG. 10 is a control flow chart (4) of the invention.

Referring to FIG.6 for a diagram of a multi-region configuration system embodiment of the invention, the system 4 consists of a heat source unit 41 coupling with a plurality of refrigeration air conditioning regions R41, R42, R43, . . . for supplying heat source. Every refrigeration air conditioning region R41, R42, R43, . . . has at least one heat exchanger unit 42, 43, 44, 45, 46, 47, . . . at the refrigeration air conditioning loading side. Each heat exchanger unit 42, 43, . . . has a controller 421, 431, 441, 451, 461, 471, . . . which is same as the one shown in FIG. 3. Each controller can convert the measured power values P1*a*1, P1*a*2, . . . , P1*a*n, P2*a*1, . . . , P2*a*n, . . . , Pna1, . . . , Pnan to refrigeration air conditioning required energy value Q1*a*1, . . . , Q1*a*n, . . . , Q2*a*1, . . . , Q2*a*n, Qna1, . . . , Qnan, and then transfer respectively to the air conditioning required energy value calculation units B41, B42, B43, . . . of the corresponding refrigeration air conditioning regions R41, R42, R43, . . . to derive the required refrigeration air conditioning energy value A1, A2, A3, . . . of each region, then through the air conditioning required energy value calculation unit B41 to calculate the total required refrigeration air conditioning energy value ΣQ (ΣQ equals QA1+QA2+ . . . +QAn ). Then a heat source unit controller A40, based on the comparison result of the value ΣQ and the setting value QS, controls heat supply amount Qe of the heat source unit 41.

In the aforesaid embodiments, the heat source units 21, 31, 41, . . . may be linked to a computer center C to improve operation energy management. The computer center C can monitor and control total refrigeration air conditioning systems and achieve more efficient operation to reach optimal energy resource utilization.

FIGS. 7 through 10 illustrate the control methods of the invention, and include the following steps:

1. input power values P1*a*1, . . . , P1*a*n, . . . , Pnan and convert to refrigeration air conditioning required energy values Q1*a*1, Q1*a*2, . . . , Qnan, setting value QS, deviation value X; controllers 221 (321, 331, 341, . . . , 421, 431, 441, 451, 461, . . . ), based on the detected value P of the power value detection unit 2214, transfer to the central micro processing unit 2211 for processing and converting to individual refrigeration air conditioning required energy value Q1*a*1 (Q2*a*1, . . . , Q1*a*n, . . . , Qna1, . . . , Qnan), then input to the air conditioning required energy value calculation unit B21 (or B31, B41);

2. select operation type, based on the configuration, categorize in:

(1) single unit operation type (referring to FIGS. 4 and 8), the process flow is as follows:

I. when ΣQ=Q1*a*1, ΣQ>QS+X, total required refrigeration air conditioning energy value ΣQ (i.e. energy requirement) of the heat exchanger unit 22 at the refrigeration air conditioning loading side is greater than the setting value QS and deviation value X, heat source supply amount Qe of the heat source unit 21 controlled by the heat source unit controller A20 is the maximum value MAX;

II. when QS<=ΣQ<=QS+X, heat source supply amount Qe of the heat source unit 21 is maintained a direct proportional relationship with ΣQ value, and an equivalent refrigeration air conditioning power is provided corresponding to the refrigeration air conditioning loading to reach optimum operation efficiency;

III. when ΣQ<QS, energy requirement of the heat exchanger unit 22 at the refrigeration air conditioning loading side is lower than the setting value QS, heat source supply amount Q of the heat source unit 21 is a minimum value;

(2) Region operation type (referring to FIGS. 5 and 9), the process flow is as follows:

I. when ΣQ=A1=Q1*a*1+Q1*a*2+ . . . +Q1*a*n, ΣQ>QS+X, total required refrigeration air conditioning energy value ΣQ of the refrigeration air conditioning region R30 (i.e. regional energy requirement) is greater than the setting value QS and deviation value X, heat source supply amount Qe of the heat source unit 31 controlled by the heat source unit controller A30 is the maximum value MAX;

II. when QS<=ΣQ<=QS+X, heat source supply amount Qe of the heat source unit 31 is maintained a direct proportional relationship with ΣQ value, and an equivalent refrigeration air conditioning power is provided corresponding to the refrigeration air conditioning loading to reach optimum operation efficiency;

III. when ΣQ<QS, energy requirement of the refrigeration air conditioning region R30 is lower than the setting value QS, heat source supply amount Qe of the heat source unit 31 is a minimum value;

(3) Multi-region operation type (referring to FIGS. 6 and 10), the process flow is as follows:

I. when ΣQ=QA1+QA2+ . . . +QAn, (refrigeration air conditioning required energy values of various regions are respectively QA1=Q1*a*1+Q1*a*2+ . . . +Q1*a*n, QA2=Q2*a*1+Q2*a*2+ . . . +Q2*a*n, . . . , QAn=Qna1 +Qna2+ . . . +Qnan), and ΣQ >QS+X, total refrigeration air conditioning required energy value ΣQ of all refrigeration air conditioning regions (i.e. total refrigeration air conditioning required energy value of the regions R41, R42, R43, . . . ) is greater than the setting value QS and deviation value X, heat source supply amount Qe of the heat source unit 41 controlled by the heat source unit controller A40 is the maximum value MAX;

II. when QS<=ΣQ<=QS+X, heat source supply amount Qe of the heat source unit 41 is maintained a direct proportional relationship with ΣQ, and an equivalent refrigeration air conditioning power is provided corresponding to the refrigeration air conditioning loading to reach optimum operation efficiency;

III. when ΣQ<QS, energy requirement of all refrigeration air conditioning regions is lower than the setting value QS, heat source supply amount Qe of the heat source unit 41 is a minimum value.

In summary, the control method of the invention can calculate and derive air conditioning required energy value based on output power value at the refrigeration air conditioning loading side, thereby allowing the heat source unit to generate corresponding heat source supply so that the heat source unit can make dynamic adjustment based on the refrigeration air conditioning required energy value at the loading side. As a result, the system can maintain optimum operation efficiency at any time to achieve the object of saving energy.

While the preferred embodiments of the invention have been set forth for the purpose of disclosure, modifications of the disclosed embodiments of the invention as well as other embodiment thereof may occur to those skilled in the art. Accordingly, the appended claims are intended to cover all embodiments which do not depart from the spirit and scope of the invention.

I claim:

1. A method for controlling a corresponding energy supply of a heat source unit of a refrigeration air conditioning system based on a required energy value calculated from an output power value, comprising the steps of:

(1) inputting a detected power value from an output power detection unit and transferring the power value to a central micro processing unit for converting the power value to a refrigeration air conditioning required energy value, a setting value, and a deviation value, and feeding the refrigeration air conditioning required energy value to an air conditioning required energy value calculation unit; and (2) selecting an operation type categorized as a single unit, a single region or a multi-region, and the air conditioning required energy value calculation unit calculating a total refrigeration air conditioning required energy value which is transferred to a heat source unit controller to control a heat source supply under the following conditions:

I. when the total refrigeration air conditioning required energy value is greater than the setting value and the deviation value, controlling the heat source unit to provide maximum amount of the heat source supply;

II. when the total refrigeration air conditioning required energy value is greater than the setting value but less than the sum of the setting value and the deviation value, controlling the heat source unit to provide the heat source supply in a directly proportional relationship with the refrigeration air conditioning required energy value such that supplied refrigeration air conditioning power is equivalent to refrigeration air conditioning loading; and III. when the total refrigeration air conditioning required energy value is less than the setting value, controlling the heat source unit to provide a minimum amount of the heat source supply.

2. The method a claim 1, wherein the output power detection unit detects a power value output from an output unit, and the refrigeration air conditioning required energy value calculation unit accumulates a required energy value of all controllers of the refrigeration air conditioning system and derives a total refrigeration air conditioning required energy value which is transferred to the heat source unit controller for controlling the heat source supply of the heat source unit.

3. The method of claim 1, wherein the heat source unit controllers are linked to a computer center.

* * * * *